US005143465A

United States Patent [19]

Hou

[11] Patent Number: 5,143,465

[45] Date of Patent: Sep. 1, 1992

[54] FLASHLIGHT BALL-POINT PEN

[75] Inventor: Hsien-Te Hou, No. 5, Lane 279, Chung Cheng Rd., Yung Kang Hsiang, Tainan Hsien, Taiwan

[73] Assignee:

[21] Appl. No.: 705,534

[22] Filed: May 24, 1991

[51] Int. Cl.[5] ..... B43K 29/10

[52] U.S. Cl. ..... 401/195; 362/118

[58] Field of Search ..... 401/52, 195, 110, 111; 362/118, 109

[56] References Cited

U.S. PATENT DOCUMENTS

| | | | |
|---|---|---|---|
| 2,368,839 | 2/1945 | Jansen | 362/118 X |
| 2,651,709 | 9/1953 | Ross | 401/195 X |
| 2,663,791 | 12/1953 | Hettrick | 401/52 X |
| 4,028,540 | 6/1977 | Key | 362/118 |
| 4,518,274 | 5/1985 | Hanggi | 362/118 X |

FOREIGN PATENT DOCUMENTS

| | | | |
|---|---|---|---|
| 1212054 | 3/1960 | France | 362/118 |

*Primary Examiner*—Danton D. DeMille
*Attorney, Agent, or Firm*—Bacon & Thomas

[57] ABSTRACT

A flashlight ball-point pen includes a light which is operable independently of a shank which carries a nib and forms a ball-point pen reservoir. The outside of the flashlight ball-point pen appears as a traditional ball-point pen, but the cap of the pen includes a battery and a light, while the shaft of the pen contains the shank and nib. By turning the cap, a contact is rotated to alternately open and close a circuit which turns on the light. In addition, the cap may, independently of turning the light on or off, be moved to cause the shank to extend from or retract into the shaft. When the light is turned on, light passes around the shaft and exits through a transparent cone shaped cover at one end of the pen.

5 Claims, 8 Drawing Sheets

FLASHLIGHT BALL-POINT PEN

BACKGROUND OF THE INVENTION

Flashlight ball-point pens have been displayed and sold on the market to provide illumination under bad lighting conditions, for instance, when people attend a meeting which requires a dim light in order to use a slide projector and they need to write notes on key points, or when people need to write at night time in their room and do not wich to bother others.

Most of the prior art flashlight ball-point pens are divided into two types; one type has a permanent nib extending out of a shaft with only the light being adjustable, while the other type has an adjustable nib and the lightr is also adjustable. The former is very easy to damage clothes by the ink from the nib, while the latter one drains the battery when the nib extends out and retracts back into a shaft, and the light turns on an off simultaneously regardless of the illumination condition of the place. In addition, most prior art devices are either integrally formed or have too many parts to assemble. The integrally formed one has to be disposed of when the battery is dead, while the latter one is too complicated and does not comply with the principle of cost effectiveness.

The inventor has, therefore, invented the present invention to eliminate all of teh above-mentioned inconveniences.

SUMMARY OF THE INVENTION

It is the primary object of the present invention to provide an improved flashlight ball-point pen which light is operable independent of the shank.

It is another object of the present invention to provide an improved flashlight ball-point pen which uses a few parts to achieve its goal.

It is still another object of the present invention to provide an improved flashlight ball-point pen with parts which are replaceable.

It is a further object of the present invention to provide an improved flashlight ball-point pen which complies with the principle of cost effectiveness.

It is still a further object of the present invention to provide an improved flashlight ball-point pen which easy to operate.

DETAILED DESCRIPTION OF THE PREFERRED EMBODIMENT

Figure 1:
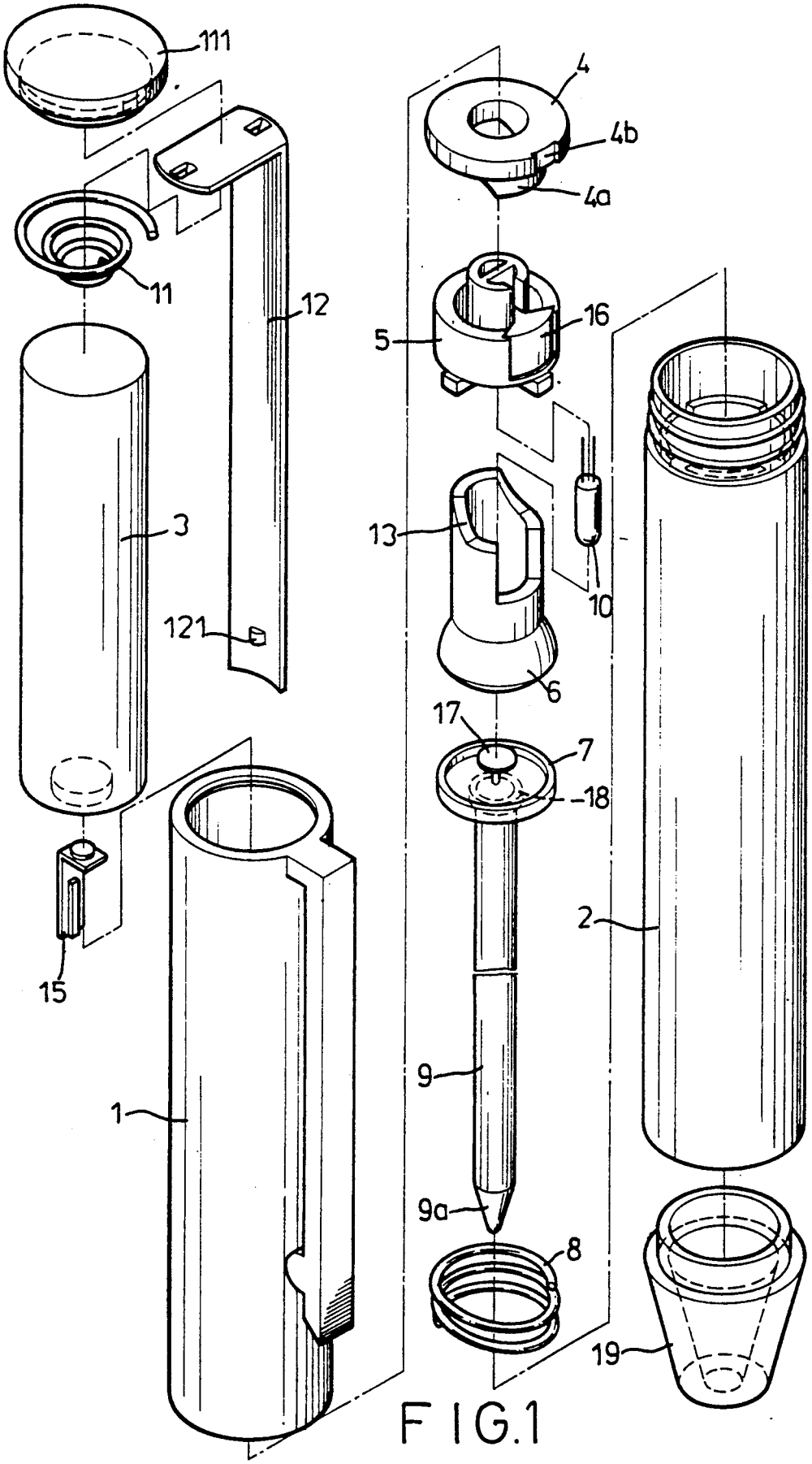
FIG. 1 is exploded view of the present invention.

Reference is now made to FIG. 1. The present invention is composed of a cap 1 rotatably mounted to a shaft 2 and having within their body a battery 3, an acturating ring 4, an engaging member 5, a shield 6, a reflector 7 on to of a shank 9, and a spiral spring 8. Shank 9 and nib 9*a* form an actual working ball-point pen reservoir. The battery has a negative end in contact with one end of a coiled spring 11 and a positive end in contact with one end of an anode plate 15. An end of a cathode plate 16 is inserted through a hole of the actuating ring 4 into a passage of the engaging member 5. The other end of the coiled spring 11 is in contact with an end of an L-shaped conducting strip 12. The other end of the conducting strip 12 extends downward to and is in contact with the outer surface of the engaging member 5 by a protuberance 121 located close to its end. The top portion of the conducting strip 12 is dimensioned slightly less than the inner diameter of a screw 111 so as to be placed within the screw 111 and rotated with the cap 1. The engaging member 5 is fixedly connected to the top inner portion of the shaft 2, as shown by the phantom line, and has a boss at its center portion and a passage extending along an axis therethrough which is divided into two partitions with one to accept the anode plate 15 and the other to accept the cathode plate 16. The engaging member 5, further, had a through hole between the boss and the circular body extending along the axis therethrough. A bulb 10 within the shield 6 is located underneath the engaging member 5 with its two contacts inserted into the two partitions of the engaging member 5 and with one contact connected to the anode plate 15 and the other contact connected to the cathode plate 16. The battery 3 has its positive end connected to one contact of the bulb 10 through the anode plate 15 and its negative end connected to another contact of the bulb 10 through the coiled spring 11 and conducting strip 12. This forms a circuit and direct current is provided to and light up the bulb 10. The shield 6 located on top of the reflector 7 has an arcuate glass at its bottom end and an open end at its top portion formed with a protruding portion 13 which is inserted from the bottom of the engaging member 5 and extends out through the through hole of the engaging member 5. The actuating ring 4 located on top of the engaging member 5 has a ledge 4*a* at one end facing downward to be placed on top of the engaging member 5 and a recess 4*b* at its periphery which is sized for receiving the extending portion of the conducting striip 12 so as to actuate the movement of the conducting strip 12. The reflector 7 is connected to the top end of the shank 9 and placed underneath the shield 6, and has reflecting member 17 provided with a chemical material, such as mercury, that is able to reflect light, and a transparent saucer 18.

Figure 2:
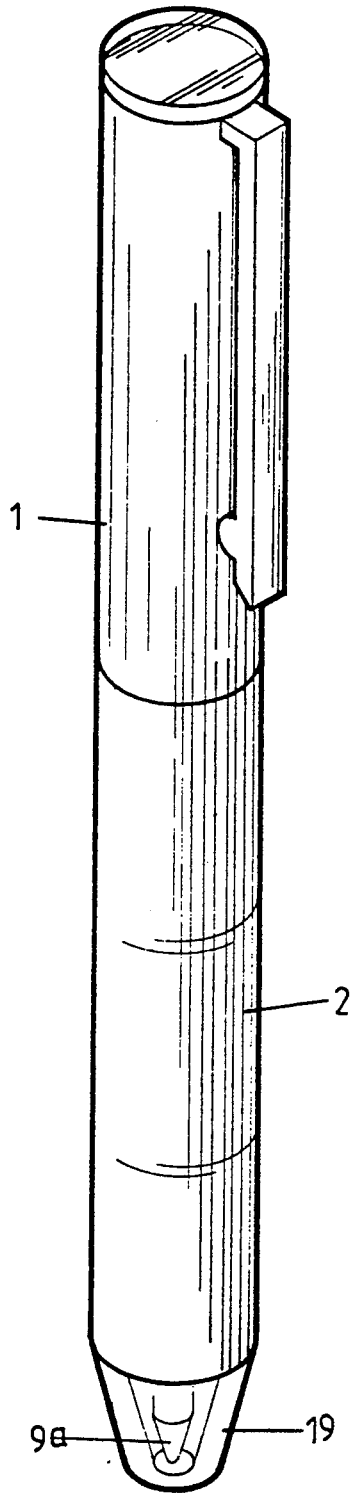
FIG. 2 is a perspective view of FIG. 1.

The spiral spring 8 has one end touching the bottom end of the reflector 7 and the other end placed on a circular bulged portion in the shaft 2. A transparent cone-shaped cover 19 is adapted to be connected to the bottom end of the shaft 2 such that light passing around the shaft exits through cover 19. When the flashlight ball-point pen of the present invention is assembled, the outer configuration appears to be indentical to a normal ball-point pen, as shown in FIG. 2.

Figure 3A:
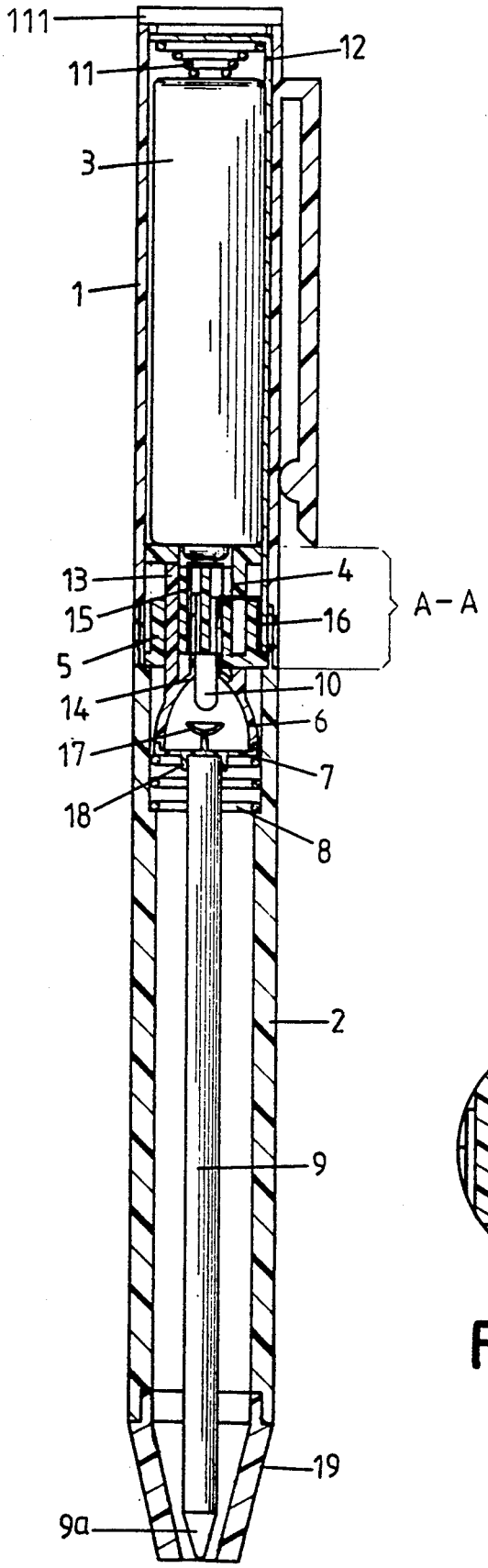
FIG. 3A is a cross-sectional view of FIG. 1.
Figure 3B:
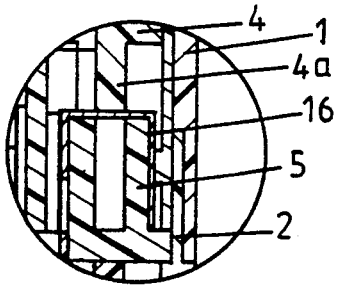
FIG. 3B is an elevation view of FIG. 3A taken on line A—A.
Figure 4A:
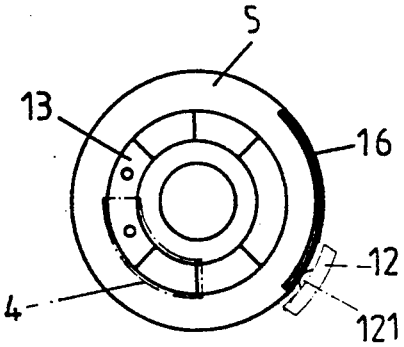
FIGS. 4A and 7A are top sectional views of FIG. 1 showing a protuberance is in contact with a cathode plate and forming a circuit loop.
Figure 5A:
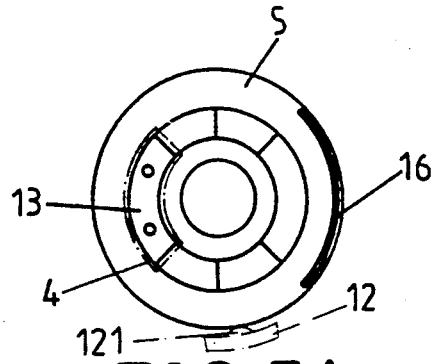
FIG. 5A and 6A are top sectional views of FIG. 1 showing the protuberance out of contact with the cathode plate and the circuit in an open status.
Figure 4B:
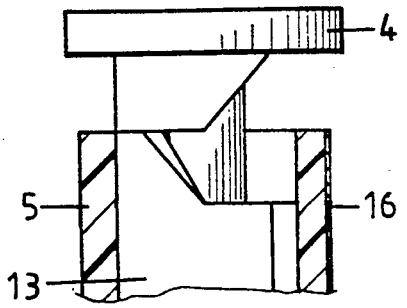
FIGS. 4B and 5B are side sectional view of FIG. 1 in which a pen is pushed downward and a nib extends out of the shaft.
Figure 5B:
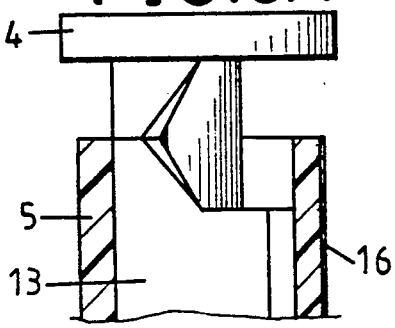
Figure 6A:
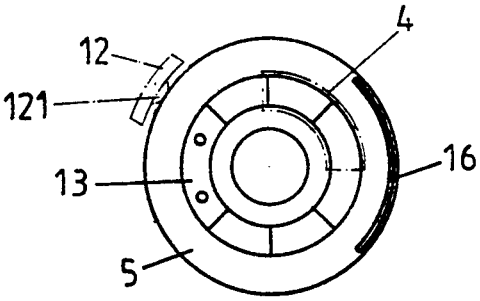
Figure 7A:
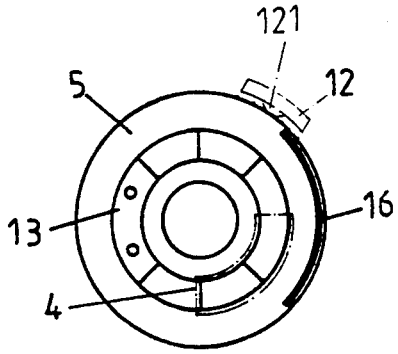
Figure 6B:
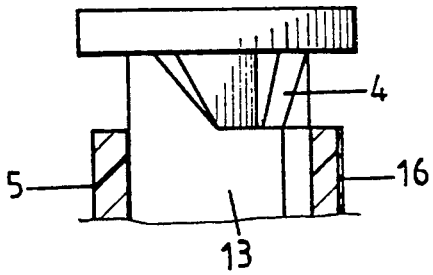
FIGS. 6B and 7B are side sectional views of FIG. 1 showing the shank of the pen released from the pushing force.
Figure 7B:
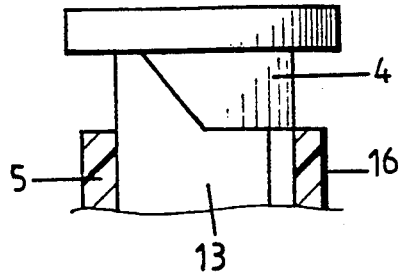

The embodiment shown in FIGS. 3A and 3B operates in accordance with the positions shown in FIGS. 4A, 4B, 5A, 5B, 6A, 6B, 7A, and 7B. FIGS. 5A and 5B show the protuberance 121 of the conducting strip 12 being contact with the cathode plate 16 forming a closed circuit therein and causing the bulb 10 to be turned on. The nib 9*a* of the shank 9, because the ledge 4*a* is not pressing the protrusion portion 13 of the shield 6 from the top, remains in the shaft 2 (please refer also to FIGS. 7A and 7B). The bulb 10 and the nib 9*a*, according to the present invention, are each operable independently. For instance, when the cap 1 is rotated to a first position in which the protuberance 121 of the conducting strip 12, according to FIG. 4A, is in contact with the cathode plate 16 rather than the shield 6, the shank 9 is pressed downward by the ledge 4B, as shown in FIG. 4B, the bulb 10 will turn on and the nib 9*a* will extend out of the shaft 2. When the conducting strip 12 is rotated to a second position where the protuberance 121 of the conducting stripi 12 is separated from the cathode plate 16 of the engaging member 5, and the ledge 4*a* is still pressing the protrusion portion of the shield 6 from its top, as shown in FIGS. 5A and 5B, the circuit is in an open status which turns off the bulb 10 and forces the nib 9*a* of the shank 9 to extend out of the shaft 2. FIGS. 6A and 6B show the position in which the conducting strip 12 has reached a third position where the protuberance 121 is displaced from the cathode plate 16 and the ledge 4*a* is not on top of the protrusion protion 13 of the shield 6, causing the light to be turned off and the nib 9*a* of the shank 9 to be retracted back into the shaft 2 because of the elastic force of the spiral spring 8. FIGS. 7A and 7B show the situation in which conducting strip 12 has reached the fourth position where the protuberance 121 is in touch with the cathode plate 16 and the ledge 4*a* of the actuating ring 4 is not on top of the protrusion portion 13 of the shield 6 which energizes the bulb 10 and retracts the nib 9*a*.

Figure 8:
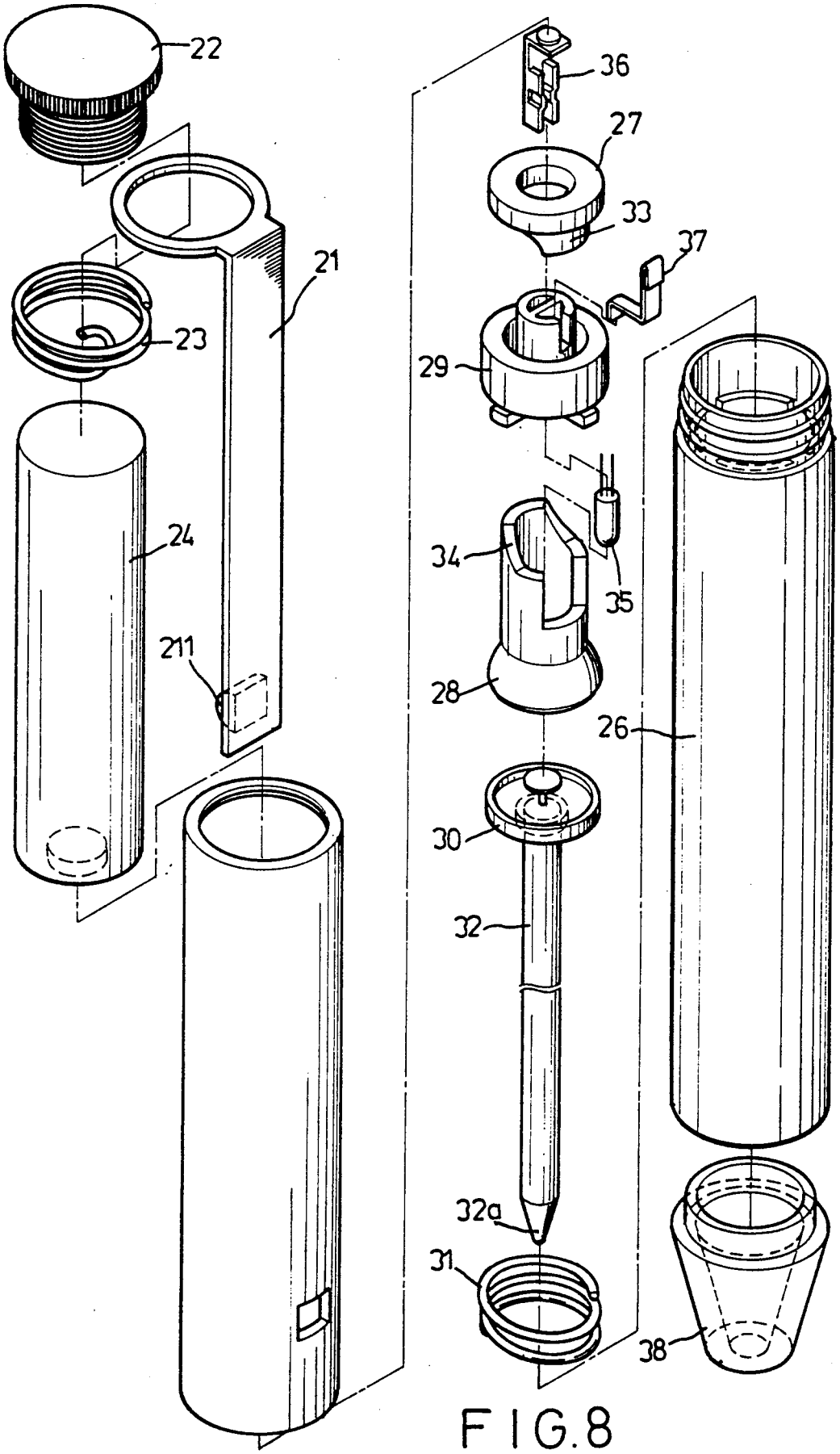
FIG. 8 is another fragmentary view showing a second embodiment of the present invention.
Figure 9:
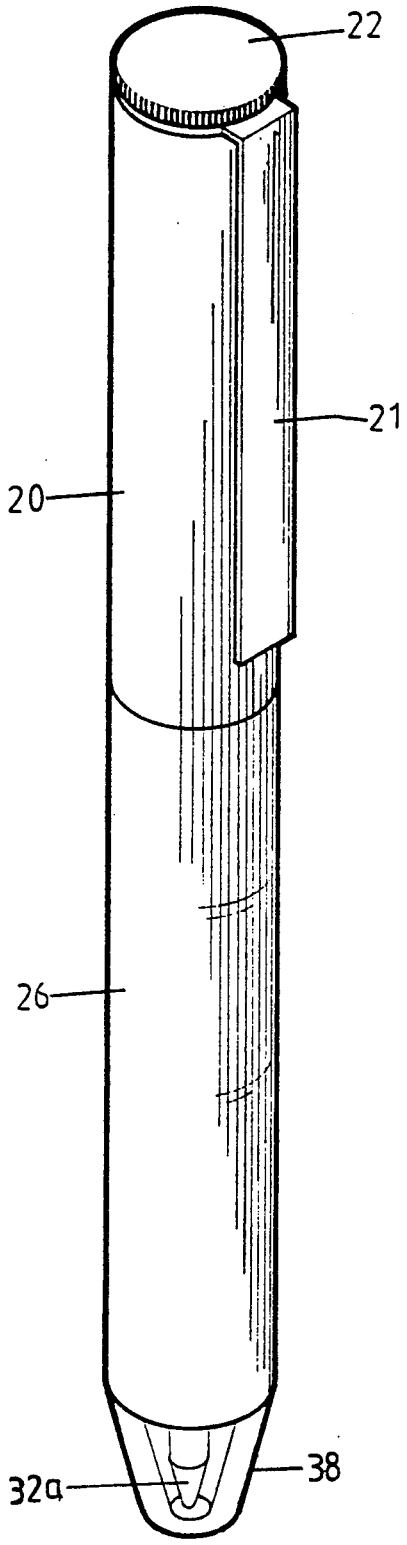
FIG. 9 is a respective view of FIG. 8

The first embodiment of the present invention, according to FIGS. 8 and 9, shows a modification of the present invention in which the conducting strip 12 is omitted and which uses a clip 21 instead of the conducting strip 12. The clip 21 is placed outside of the cap 20 having a protuberance 211 at its bottom inner end. The cap 20 has an aperture 25 at its lower portion for insertion of the protuberance 211 of the conducting strip 21 which is in contact with the outer surface of the engaging member 29. A lateral circular portion is provided at the upper end of the clip 21 in contact with a conducting spring 23 which again is contact with the negative end of the battery 24. The circular portion of the clip 21 has an inner diameter greater than that of a theaded portion of screw 22 and less than that of head of screw 22 so as to be freely rotated when screw 22 is screwed into the cap 20. The positive end of the battery 24 is in contact with the anode plate 36 which is then inserted through the hole of the actuating ring 27 into a partition of the engaging member 29 and connected with the positive foot of the bulb 35, the negative foot of which is inserted into another partition of the engaaging member 29 and connected with the cathode plate 37. When the protrusion portion 34 of the shild 35 is pressed by the ledge 33 of the acturating ring 27 from top, the shield 35 if forced to move downward, which presses the shank 9 downward and causes the nib 32*a* to extend out of the shaft 26. Since the clip 21 is not actuated along with the cap 20, the protuberance 211 of the clip 21 may be moved to any place at any time. If the protuberance 211 is not is contact with the cathode plate 37, the circuit is in open status and the light is not turned on. Conversely, if the protuberance 211 is in contact with the cathode, the circuit is closed and the light turns on.

Figure 10A:
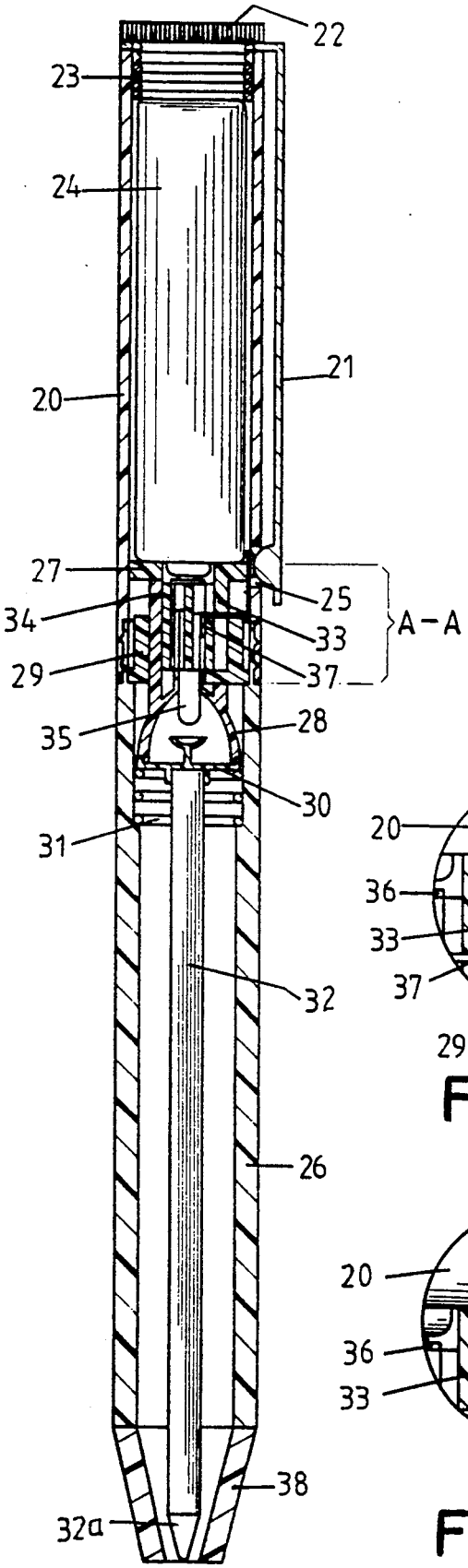
FIG. 10A is a sectional view of FIG. 8F
Figure 10C:
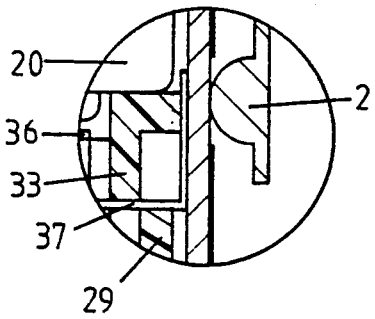
FIG. 10C is also an elevational view similar to FIG. 10B but showing a modification.
Figure 10B:
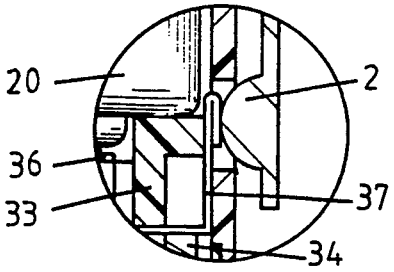
FIG. 10B is an elevational view taken partially on the line A—A, FIG. 8.
Figure 11A:
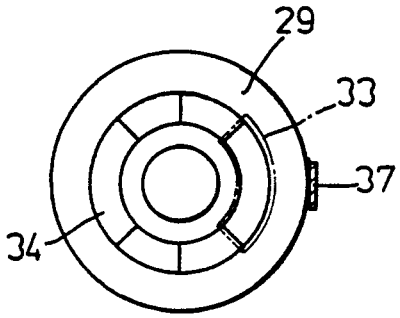
FIGS. 11A and 12A are top sectional views of FIG. 8 showing the relationship between a protuberance and a cathode plate.
Figure 11B:
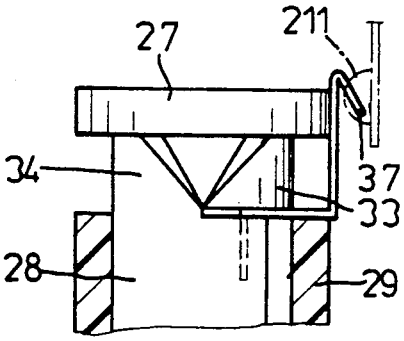
FIGS. 11B and 12B are side sectional views of FIG. 8 showing the relationship between an actuating ring and a bulb shelter.

Reference is made to FIG. 10A which is a cross-sectional view of FIG. 8 showing the protuberance 211 of the clip 21 in contact with the cathode plate 37 (please refer to FIG. 10B) and the ledge displaced from the protrusion portion 34 of the shield 35 (shown also in FIGS. 11A and 11B) that causes the light to turn on and the nib 32*a* of the shank 32 to stay in the shaft 26. In the modification shown in FIG. 10C, the outer surface of the cap 20 is applied with a non-conducting material and the periphery (edge) of the aperture 25 is applied with conducting material and connected with the cathode plate 37 such that when the protuberance 211 of the clip 21 reaches the hole 25, a circuit loop is formed and D.C. current is supplied to light the bulb 35.

Figure 12A:
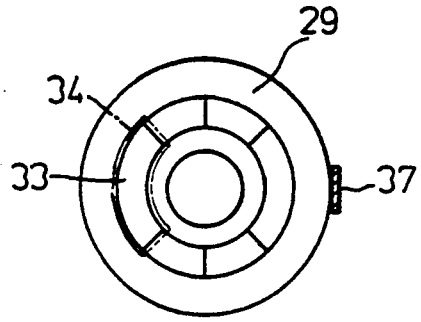
Figure 12B:
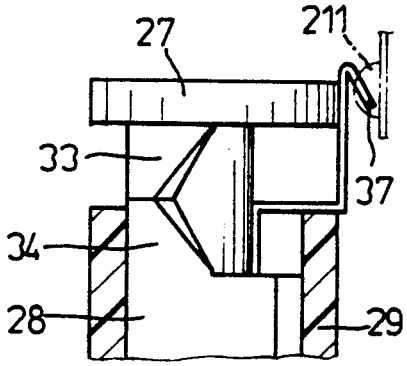

FIG. 12A shows the situation in which the protuberance 211 of the conducting striip 21 is displaced from the cathode plate 37, which turns off the light, and FIG. 12B shows the situation in which hte ledge 33 of the actuating ring 27 is on top of the protrusion portion 34, which cause the nib 32*a* of the shank 32 ot proturde out of the shaft 26. The small hole 225 of the cap 20 may be connected directly to hte negative foot of the bulb 35 to form a conducting hole.

I claim:

1. An improved flashlight ball-point pen comprising:

a cap which includes a cylindrical body; a shaft on which the cylindrical body is rotatably mounted; a battery contained within said cylindrical body; an actuating ring movable with the cap; an engaging member; a shield; an anode plate; a cathode; a shank which forms a ball-point pen reservoir and which includes a nib at one end; a conducting strip; a reflector; a light bulb; a coiled spring and a spiral spring, wherein said actuating ring has a central hole; a ledge at one side facing downwardly towards said nib end; and a recess at a periphery of said actuating ring which forms means for moving said conducting strip with respect to said cathode in response to movement of the cap;

wherein said engaging member includes a boss at a central protion, and a passage extending through the boss along an axis of the boss and divided into two partitions; and a through hole extending in a direction of said axis between said boss and the cylindrical body, said engaging member and boss being fixedly connected to said shaft, wherein said shield includes an arcuate glass portion which faces downwardly toward said nib end and a protrusion portion facing upwardly toward said cap and protruding through said through hole to engage said ledge, wherein said shank includes a reflector at a top portion opposite said nib and located underneath and in contact with said shield, wherein said battery has a negative end connected to an end of said coiled spring and a positive end connected to an end of said anode plate, wherein another end of said anode plate extends through the central hole of said acuating ring and through one of said partitions of said engaging member, and is connected with one contact of said light bulb, wherein another contact of said bulb is inserted into the other of said two partitions and electrically connected with said cathode, wherein said conducting strip has an end in contact with the other end of said coiled spring, another end of said conducting strip extending downwardly toward said nib end and having a protuberance near said other end in contact with an outer surface of said engaging member and forming means for engaging and disengaging said cathode upon rotation of said cap and shaft relative to one another, and wherein said spiral spring is arranged on a circular bulged portion within said shaft and has a second end which engages a bottom end of said reflector to bias said shank against said shield and said protruding portion of said shield against said actuating ring, such that rotation of said shield and actuating ring relative to each other cause engagement and disengagement of said ledge and protruding portion and consequent extension and retraction, respectively, of said nib, wherein by rotating said cap or said shaft, said bulb is lit when said protuberance contacts said cathode and said nib is extended ro retracted in response to engagement and disengagement of said ledge from said protruding portion of said shield, simultaneously or at different times depending on the relative rotational position of the cap and shaft.

2. An improved flashlight ball-point pen is claimed in claim 1, wherein said shield includes a hollow body for receiving said bulb; and said reflector is arranged to reflect light received from said bulb to said arcuate glass portion, which includes a reflecting member aranged to reflect light from the reflecting member through a transparent saucer at one end of the shank and a transparent cone shaped cover at another end of the shank.

3. An improved flashlight ball-point pen as claimed in claim 1, wherein said conducting strip comprising a clip said protuberance is formed near one end of said clip, and said cap has an aperture arranged to receive said protuberance, wherein when protuberance is received within said aperture, a closed circuit is formed to light said bulb.

4. An improved flashlight ball-point pen as claimed in claim 3, wherein said clip is arranged to rotate within a screw which is threaded onto said cap.

5. An improved flashlight ball-point pen as claimed in claim 3, wherein said aperture is adjacent to an exposes an end of said cathode which extends from said engagement member and contacts said protuberance when said protuberance is received within said aperture.

* * * * *